US005170705A

United States Patent [19]

Haroutel

[11] Patent Number: 5,170,705

[45] Date of Patent: Dec. 15, 1992

[54] POSTAGE METER HAVING A REMOVABLE PRINT HEAD

[75] Inventor: Jean-Claude Haroutel, Orsay, France

[73] Assignee: Alcatel Satmam, Bagneux, France

[21] Appl. No.: 727,170

[22] Filed: Jul. 9, 1991

[30] Foreign Application Priority Data

Jul. 10, 1990 [FR] France ..... 90 08752

[51] Int. Cl.[5] ..... B41L 47/46

[52] U.S. Cl. ..... 101/91; 101/45

[58] Field of Search ..... 101/45, 91, 92, 109, 101/216, 232-243, 245, 375, 378; 235/101

[56] References Cited

U.S. PATENT DOCUMENTS 4,519,311 5/1985 Lowe ..... 101/91
4,682,541 7/1987 Pollak, Jr. et al. ..... 101/91
4,774,881 10/1988 Schubert ..... 101/91

FOREIGN PATENT DOCUMENTS 0221555 5/1987 European Pat. Off. .
0376528 7/1990 European Pat. Off. .

*Primary Examiner*—Clifford D. Crowder
*Assistant Examiner*—Stephen R. Funk
*Attorney, Agent, or Firm*—Sughrue, Mion, Zinn, Macpeak & Seas

[57] ABSTRACT

The postage meter has a removable head on a base and includes a sheath carrying a print drum in the head. The sheath is rotatably mounted in the head. The bore in the sheath is accessible from a far side of the head. The meter further includes a spindle which is rotatably mounted in the base and which is coupled to an internal drive mechanism for driving the platen in the base, and whose "near" end portion receives the sheath when the head is installed on the base, for the purpose of driving the sheath and thus the drum from the base.

15 Claims, 2 Drawing Sheets

POSTAGE METER HAVING A REMOVABLE PRINT HEAD

The present invention relates to a postage meter having a print head removably mounted on a base.

BACKGROUND OF THE INVENTION

Conventionally, postage meters essentially comprise a rotating drum for printing fixed and variable franking data, and, where applicable, for printing advertising data; accounting means essentially provided for keeping the financial accounts of the meter as and when mail articles are franked; a mechanism for advancing articles to be franked and including at least one platen roller facing the drum; and control circuits causing the drum to rotate through one turn each time successive articles are to be franked, and controlling the accounting means accordingly.

The rotating print drum has both peripheral printing plates for printing fixed franking data and advertising data, and also print means for printing variable data, in particular the postage value and date. These print means are usually sets of wheels which are mounted to project slightly from the periphery of the drum, through suitable openings in the postal image printing plate, and which rotate with the drum. In a variant, the print means for printing the variable data may be constituted by a row of ink jet nozzles, mounted inside the drum and with the nozzles facing the platen being triggered when each opening in the postal image printing plate moves round to coincide with the nozzles.

Existing postage meters are either one-piece units, e.g. small meters referred to as "office portable" meters, or else they have a removable print head installed on a base, e.g. large meters for processing greater volumes of mail. For reasons of security against possible fraud, users are not allowed access to the inside of one-piece meters. For the same reasons, in a meter having a removable head, the head constitutes a secure portable assembly which contains, in particular, the drum and the accounting means together with the control circuits for controlling the accounting means. The base essentially includes a conveyor mechanism for advancing articles, a drive motor for this mechanism and the control means for controlling the drum, this control generally being taken from the conveyor mechanism motor via a controlled clutch.

A meter having a removable print head requires mechanical and electrical coupling means to be provided between the head and the base to drive the drum and to synchronize the commands of the circuits in the head and in the base. Such removable installation of the head also requires the head and base to be equipped with positioning means, so that the head can be installed accurately in its position on the base and so that the head and the base can be coupled together both mechanically and electrically.

Mechanical coupling is conventionally provided by means of a driving gear wheel in the base, which gear wheel projects a little into the location provided on the base for receiving the head, and by means of a gear wheel in the head, which gear wheel is carried by the drum drive shaft and also projects a little from beneath the head. Electrical coupling is provided by two complementary connectors, one in the base and one in the head.

Both mechanical and electrical coupling between the base and the head pose numerous practical problems. They make mechanical and electrical interface circuits complex. In particular, to achieve satisfactory mechanical coupling of the head on the base, it is necessary to achieve almost perfect centering of the head drum drive shaft relative to the base drive shaft and relative to the transmission mechanism in the base between this drive shaft and the driving gear wheel. This mechanical coupling requires a large number of parts in the base, and installation and positioning tolerances that are difficult to comply with.

An object of the present invention is to define a new design of removable print head on a corresponding base, to avoid the above-mentioned drawbacks and, furthermore, to avoid the risks of damaging the couplings between the base and the head, in particular during installation of the head. The invention thus makes it possible to standardize all ranges of postage meters, which can advantageously all be made with removable heads (including the meters in the small range, in which access to their circuits and mechanisms need only be prevented in their heads).

SUMMARY OF THE INVENTION

The invention provides a postage meter having a removable print head on a base, said meter including, firstly, a rotating print drum and accounting circuits in the head, and secondly, a platen roller, drive means and control means in the base, and mechanical drive coupling means and electrical coupling means between the head and the base, wherein said meter further includes a sheath rotatably mounted in the head transversely to the "near" and "far" walls of the head, which sheath carries said drum at its near end portion inside the head, and has its bore accessible at its opposite end, at the far side of the head, and wherein it further includes a spindle mounted transversely to the "near" and "far" walls of the base and rotatable in the base and coupled to said drive means, which spindle has its "near" end portion accessible from a recess provided at the near side of the base for receiving the head, and is of substantially identical cross-section to the bore of the sheath so as to receive the sheath onto itself, thereby together constituting said drive coupling means.

The sheath or the spindle, and advantageously both the sheath and the spindle, may project respectively from the far side of the head and from the location for the head on the near side of the base, and have complementary rotary locking means for a defined angular position.

BRIEF DESCRIPTION OF THE DRAWINGS

An embodiment of the invention is described by way of example with reference to the accompanying drawings, in which.

DETAILED DESCRIPTION

Figure 1:
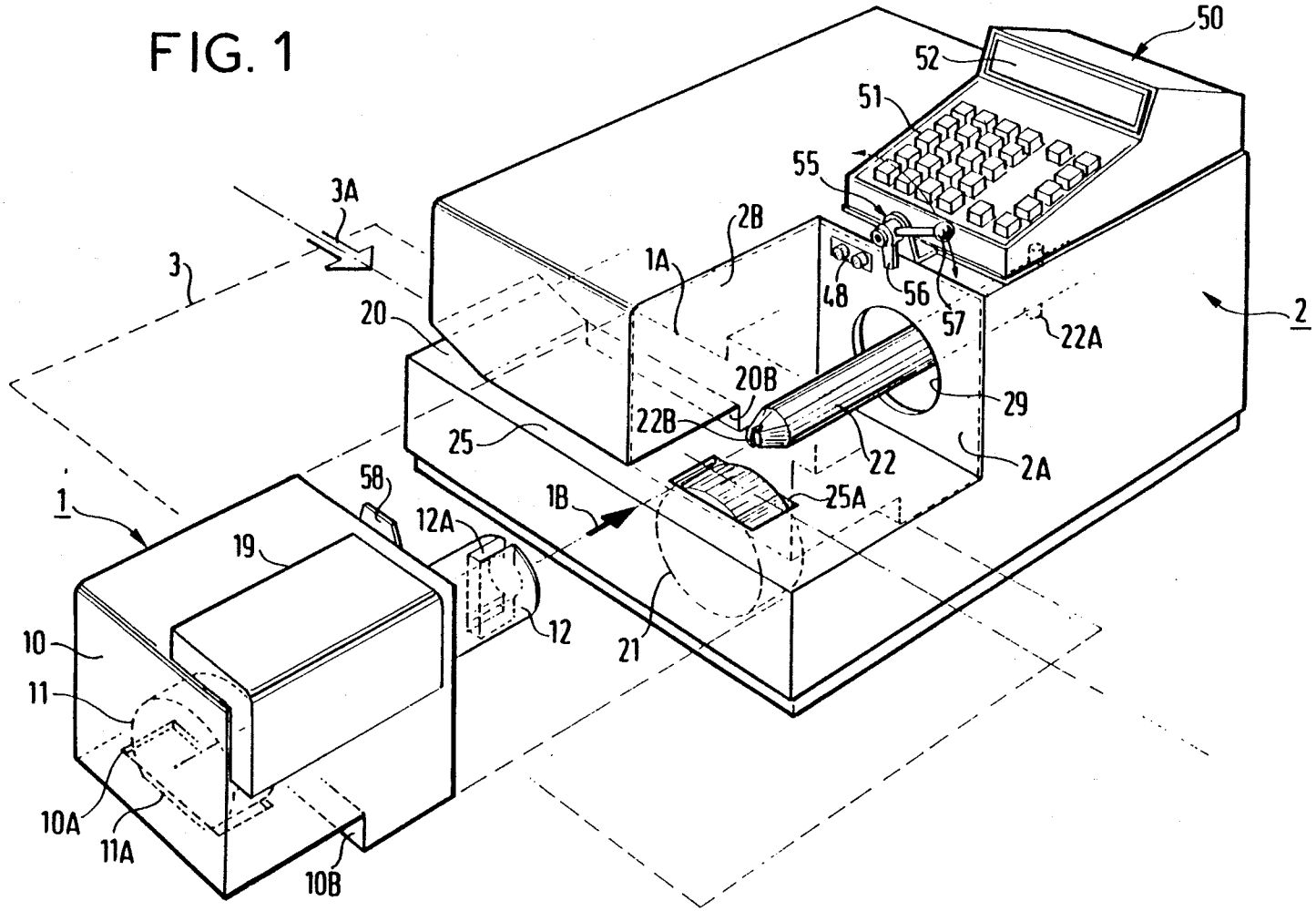
FIG. 1 is a diagrammatic perspective view of a postage meter of the invention, said meter having a base and a removable print head, the print head being shown removed from the base and its position on the base being outlined by dashed lines.
Figure 2:
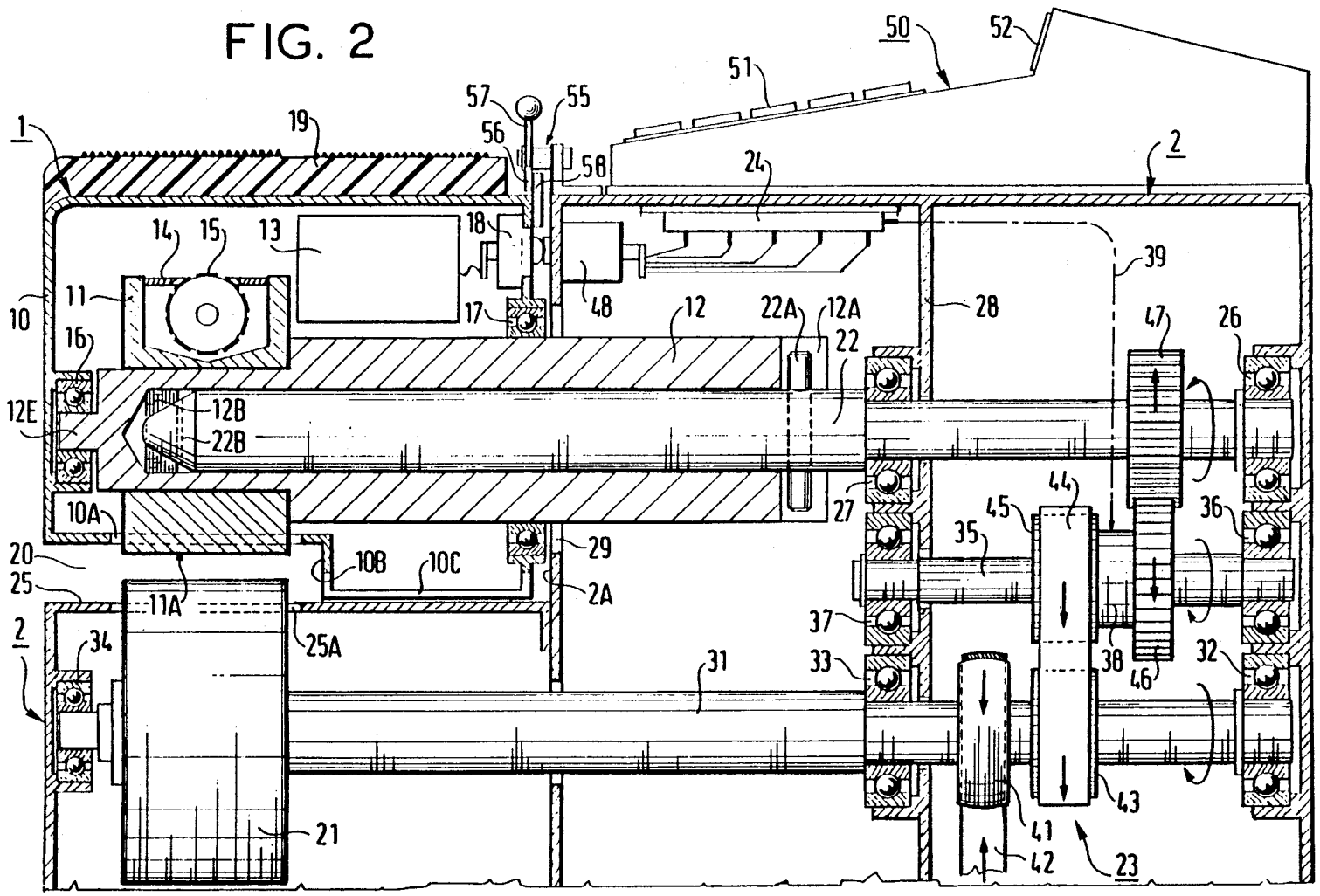
FIG. 2 is a diagrammatic view partially in section of the FIG. 1 meter which is shown on a larger scale than FIG. 1 and with its print head in position on the base.

With reference to FIG. 1 and/or FIG. 2, it can be seen that the postage meter has a print head 1 and a base 2 from which the head may be removed. In FIG. 1, dashed lines 1A show the head 1 in position on the base, with reference 1A also being used to designate the recess for or the location of the head 1 on the base 2. In FIG. 2, the head, now in position on the base, still has the reference 1. The operation of installing the head is represented diagrammatically in FIG. 1 by an arrow 1B. FIG. 1 also shows an article 3 inserted in the meter and advancing in the direction of an arrow 3A.

The print head 1 forms a unit whose component parts are mounted in a casing 10 which is almost entirely enclosed and which is sealed to prevent user access. The print head essentially comprises a print drum 11, a sheath 12 carrying the drum and an "accounting card" 13 containing the accounting circuits of the meter.

A more detailed description of the head is given below, with the head being assumed to be disposed as it is when it is about to be installed or when it is in position on the base, as shown in the figures.

The print drum 11 is mounted directly onto the near end portion of the sheath 12. In the rest position, the print drum emerges slightly from the bottom of the casing 10 through a transverse window 10A in the bottom, the window being specially provided for the print drum. The rest position is defined by a flat portion 11A on the periphery of the drum. The transverse window 10A for the drum is just on the near side of an intermediate shoulder 10B on the bottom of the casing. The far portion of the bottom extends further downwards than the near portion and is in turn provided with a longitudinal window 10C opening out into the shoulder 10B and into the far wall of the casing. The purpose of this longitudinal window is described below.

In addition to its flat portion, the drum 11 has peripheral print means for printing fixed and variable postage data and also advertising data.

In the example shown, the print means are constituted by a printing plate 14 fixed on the periphery of the drum for printing postal images and by sets of wheels such as 15 for printing the postage value and the date. Another printing plate (not shown) for printing advertising is retractably mounted on the periphery of the drum. The wheels rotate with the drum. Furthermore, they may be set in position by rack and pinion means which are known per se and are not shown.

The near end portion of the sheath 12 carries the drum inside the casing, while the opposite end of the sheath has its bore open to the far side of the head. Advantageously, the far end portion of the sheath projects considerably beyond the far side of the print head.

The sheath serves to mount and to hold the head 1 on the base 2, and it also drives the drum 11 directly from the base, as is described below.

The sheath 12 rotates inside the casing 10. It is supported and guided in rotation by two ball bearings, one of which bearings (16) is mounted on the inside face of the near wall and receives the axial end 12E of the sheath, and the other of which bearings (17) is mounted at the opening through the far wall via which the sheath passes.

The accounting card 13 is fixed to one of the side walls of the casing, on the far side of the drum. The accounting card is electrically connected to a connector 18 mounted in a corresponding window in the far wall of the casing, enabling the connector to be electrically connected to the base.

In addition to the windows 10A and 10C and the intermediate shoulder 10B on the bottom of the casing 10, and in addition to the connector 18 mounted on its far wall, the outside of the casing is advantageously provided with an extra-thick portion 19 which is preferably not smooth in order to facilitate holding the print head in the hand while the print head is being installed on and removed from the base. This extra-thick portion is preferably provided on the right-hand side of the top face and on an adjoining part of the right-hand side face of the casing 10, as seen by the user facing the installed meter.

The base 2 forms another assembly made separately, and to which user access is permitted, in order to allow any necessary or desired action to be taken. In the example shown, the base is substantially in the form of a rectangular block. For a user facing the near side of the base, the right-hand corner of the base is missing and is delimited by two vertical flanks 2A, 2B, the first flank 2A being set back from the near wall, and the second flank 2B being set back from the right-hand side wall, these two flanks accurately delimiting the location or recess 1A for the head, as shown by the dashed lines 1A in FIG. 1.

Naturally, this base may be coupled with or may be part of an automatic mail-processing installation in which one of the final operations in processing is a franking operation, which may be preceded by a sorting operation.

The base 2 has means for inserting the mail and for advancing it under the head. These means consist of a horizontal insertion slot 20 and of a platen roller 21. In addition to these means, the base essentially includes a spindle 22, a drive mechanism 23 for driving the articles and the head, and at least one "control card" such as 24 including the control circuits for the base and for the head.

The insertion slot 20 opens out to the near side of the base. A leading end of the slot opens out to the left-hand side wall of the base and a trailing end of the slot opens out to the bottom of the side of the head-receiving recess 1A on the base. Upstream and downstream from the trailing end, the bottom of the slot forms a continuous horizontal platform 25 for the articles passing through the base and under the installed head. The slot is limited in depth. The far side of the slot forms a vertical abutment 20B for aligning the articles. This abutment 20B coincides with the shoulder 10B which is provided on the bottom of the head and which extends the abutment when the head is installed.

Beyond this slot 20, the platform 25 co-operates with the above-mentioned flanks 2A and 2B to delimit the head-receiving recess 1A on the base and contributes to installing the head correctly. The platen 21 projects through a window 25A in this platform 25 and faces the print drum.

The spindle 22 receives the sheath 11 and drives it directly. The spindle is horizontally and rotatably mounted in the base. The near end portion of the spindle is accessible for receiving the sheath. The spindle projects a considerable distance into the head-receiving recess 1A on the base. The spindle is supported and guided in the base by two ball bearings, one of which bearings (26) is mounted on the inside face of the far wall of the base, and the other of which bearings (27) is mounted on a supporting spacer 28. The spindle projects into the head-receiving recess 1A through a large opening 29 provided in the vertical flank 2A and of slightly greater diameter than the sheath 12.

Inside the base, the platen 21 is carried by the near end portion of a drive shaft 31. This shaft 31 is supported and guided by three ball bearings, one of which bearings (32) is mounted on the far wall of the base, an intermediate one of which bearings (33) is mounted on the supporting spacer 28 and the other one of which bearings (34) is mounted on the near wall of the base.

Inside the base, the shaft 31 and the spindle 22 are mutually parallel and vertically one above the other. They are both mounted on the same walls and/or supports of the base as each other and are thus easy to position very accurately relative to each other to obtain the defined distance between the axis of the platen in the base and the axis of the print drum in the installed head. The shaft and the spindle can be coupled to the common drive mechanism 23 with no particular problem.

The drive mechanism 23 for both the head and the base is located entirely in the base. This mechanism consists of a system of pulleys and belts and/or gear wheels, with a jackshaft 35 for reversing the direction of rotation of the platen relative to the print drum from a common motor. This jackshaft is carried by the far wall and by the supporting spacer 28, and is mounted in ball bearings 36 and 37. The drive system is shown with a pulley 41 mounted on the platen shaft 31 and coupled by a drive belt 42 to the common motor (not shown). The system includes a transmission pulley 43 on the shaft 31, which pulley is coupled by a belt 44 to a pulley 45 on the jackshaft 35. The system further includes two meshed gear wheels 46 and 47, one of which is on the jackshaft 35 and the other of which is on the spindle 22. This drive mechanism 23 is also shown with a clutch 38 interposed on the jackshaft 35, between its driving portion with the pulley 45 and its driven portion carrying the gear wheel 46. This clutch 38 is controlled by one of the control circuit cards, as is shown by the dot-dashed link 39 with the control card 24.

The overall control card shown at 24 is fixed to the top wall of the base. In practice, this card is divided into a microprocessor control card and a power circuit card, coupled together via a suitable interface. The control card 24, or, to be more precise, the microprocessor card, is connected via a suitable protection interface, known per se, to a connector 48 mounted in a window in the vertical flank 2A. This connector 48 is complementary to the connector 18 in the head and is at the same level as the connector 18, so that the two connectors are interconnected directly when the head is installed. Advantageously, one of these connectors has push-button contacts resiliently urged outwards to establish good electric contact with the contacts on the other connector when the head is installed.

The base 2 also has an operator data input and visual display assembly 50 mounted on its top face on the far side of the print head. This assembly 50 has a keypad 51 and a display screen 52. The assembly enables the operator to enter control data or parameters and to obtain corresponding display, as is well known. The assembly is coupled to the control circuit card 24.

In this postage meter, the spindle 22 of the base 2 and the sheath 12 carrying the drum in the head 1 are constrained by complementary locking means to rotate together at an angular position defined relative to the rest position of the drum. These means are shown as being formed by a vertical slot 12A in the far end of the sheath, which slot corresponds to a pin 22A in the spindle. In this case, the spindle and the bore of the sheath are both circular in cross-section. In a variant, the locking means may be obtained by the spindle and the bore of the sheath being given triangular cross-sections, advantageously with an associated aligning or positioning component enabling the operator to position the head correctly while it is being installed and locked in rotation on the spindle. In a variant or in addition, these locking means may be constituted by a screwdriver slot such as 22B in the end of the spindle and a corresponding flat blade 12B at the bottom of the bore 12 in the sheath.

Furthermore, once the head 1 is installed, it is locked on the base 2 by manually-operated locking means shown at 55. These means are constituted by a hinged latch 56 actuated by a lever 57 coupled thereto, the latch and the lever being mounted on the base on the near side of the input and display assembly 50, and the means are further constituted by a catch 58 for locking or retaining the latch, the catch being mounted on the far side of the head. Naturally, these locking means may be of a different type, e.g. a lever and a slope, and may be mounted on the sides of the base and of the head.

Installing the head on the base (as shown by the arrow 1B) is done very simply and quickly. Installation is easy and there is no risk of damaging the coupling means. Installation consists simply in engaging the sheath 12 on the spindle and in sliding the sheath along the spindle to its fullest extent. While sliding, the window 10C in the bottom of the head enables the platen projecting from the platform 25 to avoid the head, while the side portions of the head bottom, on respective sides of this window, slide on the platform 25 and assist in guiding the head to its installed position.

This installation provides direct mechanical coupling of the drive to the head via the spindle and the sheath, with the entire drive mechanism being mounted in the base as described above and remaining accessible for any action the user may need to take. This installation also provides direct and simultaneous electrical coupling between the head and the base with no risk of damaging the contacts.

The present invention is described with reference to the preferred embodiment shown in the drawings. Naturally, certain details may be modified or certain means may be replaced by other equivalent means without going beyond the scope of the present invention.

I claim:

1. A postage meter having a base, a removable print head on said base, said print head having a near wall and a far wall, said base having a near wall and a far wall, said meter further including, firstly, a rotating print drum and accounting circuits in the head, and secondly, a plant roller, drive means and control means in the base, and mechanical drive coupling means and electrical coupling means between the head and the base, wherein said meter further includes a sheath rotatably mounted in the head, transversely to the near and far walls of the head, said sheath having a near end portion and an opposite end and carrying said drum at said near end portion of said sheath inside the head, said sheath having a bore accessible at said sheath opposite end, at the far wall of the head, and wherein said base further having a head receiving recess provided in the near wall of the base and said recess terminating in a vertical flank remote from said base near wall, and further including a spindle mounted transversely to said near and far walls of the base and rotatable in the base, and being coupled to said drive means, the vertical flank of the base being proximate to and facing the far wall of said head receiving recess, said spindle being of substantially identical cross-section to that of the bore of the sheath and being received in the sheath, thereby constituting said drive coupling means.

2. A postage meter according to claim 1, wherein said sheath has said opposite end projecting from the far wall of the head.

3. A postage meter according to claim 1, wherein said near end portion of the spindle is centered relative to an opening in a flank delimiting a far side of the head receiving recess for receiving the head on the base, with the sheath engaged in said opening when the sheath is fully mounted on the spindle.

4. A postage meter according to claim 3, wherein said spindle has said near end portion projecting into the head-receiving recess on the base.

5. A postage meter according to claim 1, further including means on said sheath and said spindle for locking said sheath and said spindle together.

6. A postage meter according to claim 5, further including positioning means on said opposite end of the sheath for finding a rest position of the drum.

7. A postage meter according to claim 5, wherein the means for locking said sheath and said spindle comprises a slot in the opposite end of the sheath and a complementary pin on the spindle positioned within said slot.

8. A postage meter according to claim 1, further including, in the base, a substantially horizontal insertion slot for inserting articles, said insertion slot opening onto a gap for advancing the articles between the drum and the platen and arranged between the drum and the platen, and wherein said head further includes a shoulder on a head bottom extending a far side of said insertion slot when the head is installed on the base.

9. A postage meter according to claim 8, wherein a portion of the head bottom on said shoulder includes a window allowing the heat to pass over the platen when the head is being installed on the base.

10. A postage meter according to claim 1, further including manual locking means carried by said base and engaging said far wall of said head for locking the head in position on the base, and said manual locking means further comprising a manual control actuator external of said postage meter for actuation by an operator.

11. A postage meter according to claim 1, wherein said electrical coupling means is constituted by a connector on the base and a connector on the head, wherein said connectors are mounted corresponding to each other, respectively on the far wall of the head and on a far side of the head-receiving recess on the base, and wherein one of said connectors has contacts that are resiliently urged outwards.

12. A postage meter according to claim 1, wherein said head has a grasping portion to be grasped by hand, said grasping portion extending over substantially adjoining portions of a top wall and on a side wall located on the outside of the base.

13. A postage meter according to claim 1, including an operator data input and visual display assembly mounted in a top wall of the base, proximate said vertical flank and coupled to said control means mounted in the base.

14. A postage meter according to claim 1, wherein said drive means comprises a drive shaft for the platen and the spindle, a jackshaft mounted in said base, and wherein said drive means further include a clutch coupled to said control means to control the drive to the spindle and disposed on said jackshaft between the drive shaft for the platen and the spindle.

15. A postage meter according to claim 14, wherein said spindle, said drive shaft for the platen, and said jackshaft for interconnecting the drive means are all rotatably mounted and carried on a same supporting spacer of the base.

* * * * *